United States Patent [19]

von Trnkoczy

[11] 4,157,053

[45] Jun. 5, 1979

[54] ADJUSTABLE CHARGE BAR

[76] Inventor: Peter von Trnkoczy, Suite 1008, 55 Maitland St., Toronto, Ontario, Canada, M4Y 1C9

[21] Appl. No.: 889,330

[22] Filed: Mar. 23, 1978

[30] Foreign Application Priority Data

Aug. 5, 1977 [CA] Canada ..... 284210

[51] Int. Cl.[2] ..... F42B 33/02

[52] U.S. Cl. ..... 86/33; 86/28

[58] Field of Search ..... 86/28, 33

[56] References Cited

U.S. PATENT DOCUMENTS

| | | | |
|---|---|---|---|
| 3,033,070 | 5/1962 | Thompson | 86/28 |
| 3,361,024 | 1/1968 | Sherrill, Jr. | 86/33 |

*Primary Examiner*—Leland A. Sebastian

*Attorney, Agent, or Firm*—Robert F. Delbridge; Arne I. Fors

[57] ABSTRACT

An adjustable charge bar for a shotgun shell reloading machine includes an elongated body having longitudinally spaced powder and shot receiving slots open at the top and bottom of the body, and a longitudinally movable slider in each slot forms variable volume powder and shot receiving chambers respectively with an inner end of the respective slot. An adjusting nut is rotatably mounted at each end of the body and is threadingly engaged by a rod extending from a respective slider such that rotation of the nut adjusts the longitudinal position of the respective slider in the body and thereby varies the volume of the respective chamber. Each nut has a core portion into which the respective rod extends in threading engagement and a sleeve portion carrying scale markings alignable with reference marking on the body. The sleeve portion is capable of assembly into fixed relationship with the core portion, after the respective slider has been moved to a predetermined position by rotation of the core portion, to position the scale markings on the sleeve part in a desired relationship with the reference marking on the body.

4 Claims, 19 Drawing Figures

FIG.4.
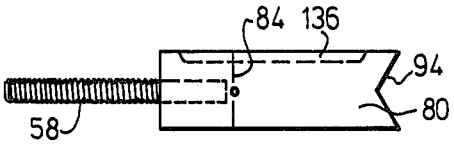
FIG.5.
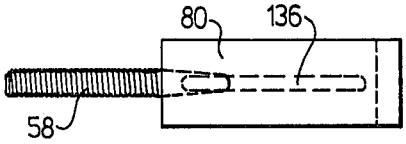
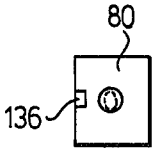
FIG.6.
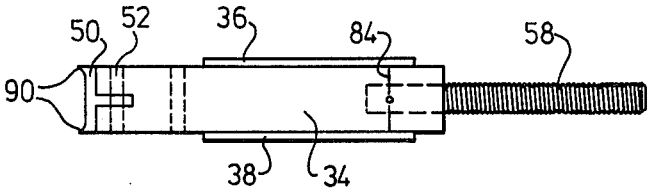
FIG.7.
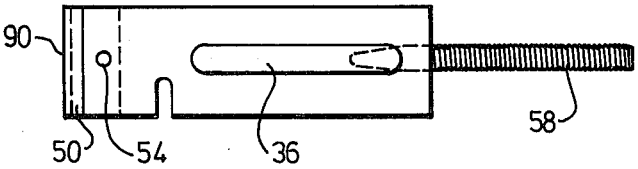
FIG.8.
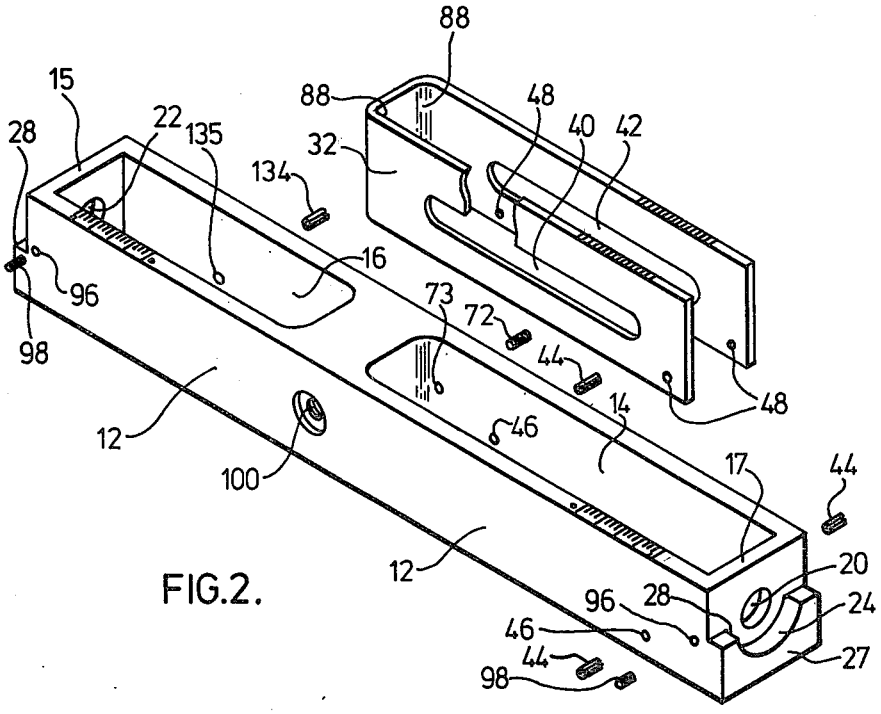
FIG.2.

ADJUSTABLE CHARGE BAR

This invention relates to charge bars of adjustable capacity for metering powder and shot in shotgun shell reloading machines.

Shotgun shells are not inexpensive, and people who use shotguns often refill shotgun shells, after they have been fired, with fresh powder and shot so that the same shell can be used many times. Manually operated machines are available for reloading shotgun shells, and such machines include some suitable mechanism for feeding fresh powder and shot into a used shell. Such machines also carry out other necessary operations on the used shell, for example re-sizing the used shell, removing the old primer and installing a new one, packing wadding between the powder and shot, and finally crimping the open end of the shell so as to close it. However, the present invention is only concerned with the manner in which powder and shot are fed into the shell.

Known manually operable reloading machines have a reciprocally mounted slider, known as a charge bar, which has powder and shot receiving chambers of adjustable volume. By appropriate manipulation of the charge bar, the chambers are positioned below supplies of powder and shot, so that predetermined quantities of powder and shot flow into the respective chambers, in accordance with the volume of the chambers, which are then respectively aligned with a tube down which the powder and shot flows.

Nowadays, there are many sizes of shotgun shells on the market which require various amounts of powder and shot. In fact, even with shells of the same size, varying amounts of powder and shot may be required for different purposes. For an effective performance, the amount of powder and shot in a shell must be accurately controlled, and hence it must be possible to reload a shell with the correct amount of powder and shot with such amounts being accurately predetermined.

Most conventional charge bars have powder and shot receiving chambers with predetermined volumes which are not variable. To change the amount of powder or shot for different loads and shells, different sized bushings have to be inserted in the chambers or another charge bar with different sized chambers has to be used. Such charge bars are usually numbered, and their respective capacities can be determined from a powder and shot chart. However, in order to have a reasonable variety of volumetric capacities available, a large number of bars and bushings are required, which is both cumbersome and expensive.

Some known charge bars have sliders to vary the sizes of the powder and shot receiving chambers. However, with such charge bars, the amounts of powder and shot metered thereby can be accurately and variably predetermined only by dispensing and measuring trial amounts of powder and shot, which is an extremely inefficient procedure.

It is therefore an object of the invention to provide a charge bar without the above mentioned disadvantages.

In accordance with the invention, a charge bar includes an elongated body having longitudinally spaced powder and shot receiving slots open at the top and bottom of the body, a longitudinally movable slider in each slot forming variable volume powder and shot receiving chambers respectively with an inner end of the respective slot, an adjusting nut rotatably mounted at each end of the body and threadingly engaged by a rod extending from a respective slider such that rotation of the nut adjusts the longitudinal position of the respective slider in the body and thereby varies the volume of the respective chamber, each nut having a core portion into which the respective rod extends in threading engagement and a sleeve portion carrying scale markings alignable with a reference marking on the body, the sleeve portion being capable of assembly into fixed relationship with the core portion, after the respective slider has been moved to a predetermined position by rotation of the core portion, to position the scale markings on the sleeve portion in a desired relationship with the reference marking on the body.

The volumes of the powder and shot receiving chambers are therefore accurately calibrated with respect to the scale markings on the adjusting nuts, with the result that desired chamber volumes can be obtained by appropriate movement of the adjusting nuts. A charge bar in accordance with the invention is consequently free from the disadvantages of prior charge bars.

The core portion of each adjusting nut may have a generally cylindrical uneven outer surface, with the sleeve portion being dimensioned such that the sleeve portion can be force-fitted over the uneven outer surface, at any desired rotational position of the sleeve portion relative to the core portion, to achieve said assembly into fixed relationship.

Advantageously, the body and sliders may be made of synthetic plastic material, with the powder receiving slot being lined with a metallic insert and the slider in the powder receiving slot having a metallic insert on its end forming the powder receiving slot, such that the powder receiving chamber is bounded by metal walls.

The body of the charge bar may carry scale markings adjacent each slider, with each slider carrying a reference marking alignable with the respective body scale markings.

One embodiment of the present invention will now be described, by way of example, with reference to the accompanying drawings, in which:

FIG. 2 is an exploded perspective view of the body and U-shaped aluminum sleeve of the charge bar;

FIG. 4 is a plan view of the shot slider of the charge bar;

FIG. 5 is a side view of the shot slider;

FIG. 6 is a front view of the shot slider;

FIG. 7 is a plan view of the powder slider of the charge bar;

FIG. 8 is a side view of the powder slider;

Figures 1, 9, 17, 18:
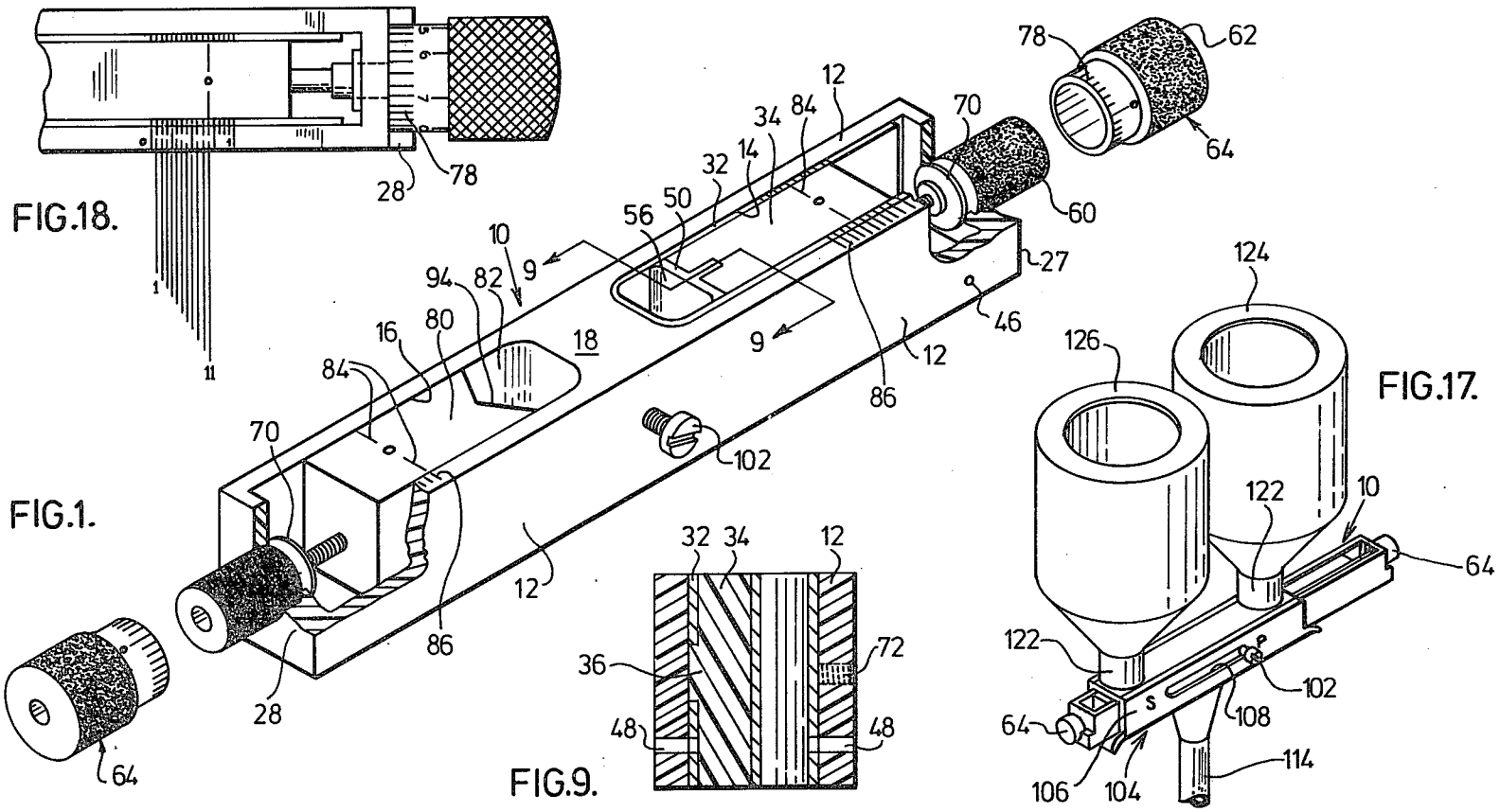
FIG. 1 is a perspective view of a charge bar.
FIG. 9 is a sectional view taken along the line 9—9 of FIG. 1.
Figure 10:
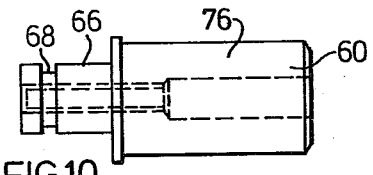
FIG. 10 is a side view, partly broken away, of the core portion of one of the adjustment nuts of the charge bar.
Figure 12:
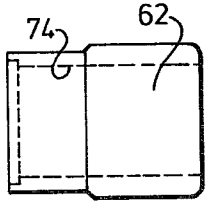
Figure 14:
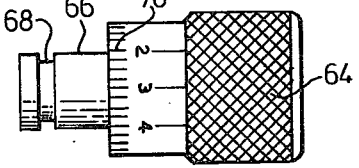
Figure 15:
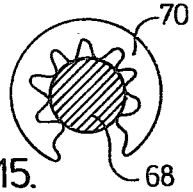
Figure 13:
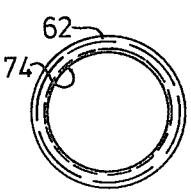
Figure 11A:
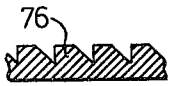
FIG. 11 is a front view of the core portion.
Figure 11:
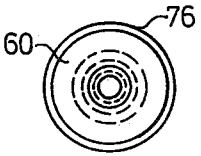
Figure 16:
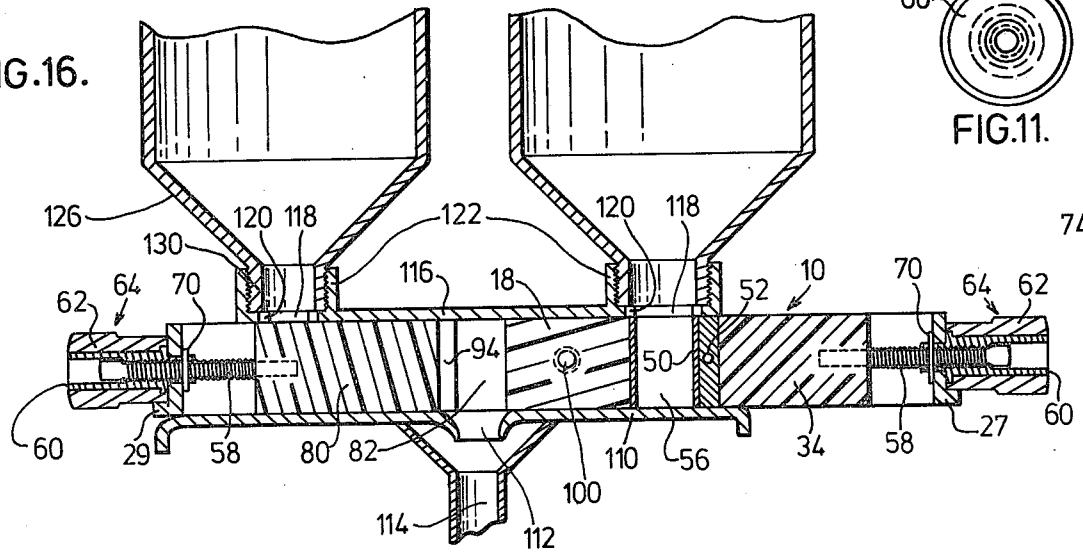
Figure 3:
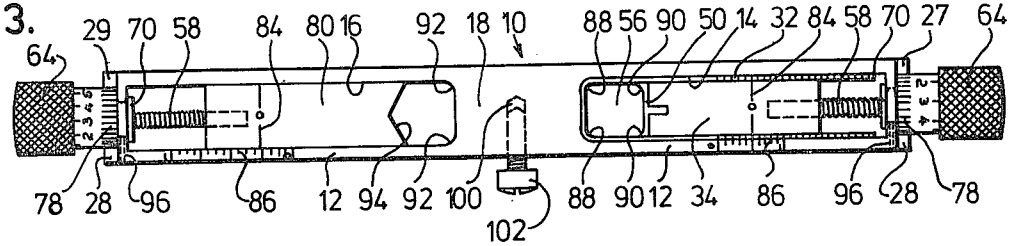
FIG. 3 is a plan view of the charge bar.

FIG. 11*a* is an enlarged view of the circled area of FIG. 10,

FIG. 12 is a side view of the sleeve portion of the nut;

FIG. 13 is a front view of the sleeve portion;

FIG. 14 is a plan view of the assembled nut;

FIG. 15 is a part-sectional end view of a lock ring in position on a nut;

FIG. 16 is a longitudinal sectional view of the charge bar mounted in the upper part of a shotgun shell reloading machine, FIG. 17 is a perspective view of the charge bar and upper part of a shotgun shell reloading machine, and FIG. 18 is a plan view of one end of the charge bar showing the scales at that end;

Referring first to FIGS. 1 to 3 of the drawings, a charge bar 10 has an elongated body 12 of synthetic plastic material and rectangular section with a pair of longitudinally-spaced elongated slots, namely a powder receiving slot 14 and a shot receiving slot 16. The slots 14, 16 extend completely through the body 12 from top to bottom, and each slot 14, 16 extends from adjacent a respective end of the body 12 for nearly half the length of the body, the slots 14, 16 being separated from one another by a central body portion 18. The shot receiving slot 16 is somewhat wider than the powder receiving slot 14.

As shown in FIG. 2, the end walls 15, 17 of the slots 14, 16 at the respective ends of the body 12 each has a circular aperture 20, 22 respectively, which is centrally located in the respective end walls 15, 17. The body 12 has extensions 27, 28 beyond the end walls 15, 17 which each has an upwardly facing semi-circular recess 24 below the respective apertures 20, 22. An upper edge 23 of each recess 24 forms a line of reference at that end of the charge bar, as will be described in more detail later.

The powder receiving slot 14 contains a U-shaped aluminum sleeve 32 which extends the full height of the slot 14 from top to bottom thereof, and which is a sliding fit with the side walls of the slot 14 and with the slot end wall formed by the central body portion 18. A slider 34 of synthetic plastic material is slidably mounted in the sleeve 32. The slider 14 extends the full height of the sleeve 32 from top to bottom thereof, and also extends the full width of the sleeve 32 so as to be a sliding fit with the side walls of the sleeve 32.

As shown in FIGS. 2, 7, 8 and 9, the sides of the slider 34 have two ribs 36, 38 on opposite sides which slide in longitudinal slots 40, 42 respectively in the aluminum sleeve 32. The aluminum sleeve 32 is secured to the body 12 by three spring pins 44 which extend through three holes 46 in the side walls of the body 12 into three holes 48 in the side walls of the aluminum sleeve 32. The slider 34 has a T-shaped aluminum insert 50 seated in a vertical slot in the inner end wall of the slider 34. The insert 50 is held in position by a spring pin 52 which extends through a hole 54 on the slider 34 and through a corresponding hole in the insert 50. A powder receiving chamber 56 is consequently formed between the insert 50 and the inner end of the aluminum sleeve 32.

A threaded rod 58 is non-rotatably secured in the slider 34 and extends from the slider 34 through the adjacent end of the body 12, passing through the aperture 20 in the end wall 17 and into an adjusting nut 64 in threaded engagement therewith. A set screw 72 is screwed into an aperture 73 in the body 12 for adjusting the width of the sleeve 32 as will be described later.

As shown in FIGS. 10 to 15, the adjusting nut 64 includes a core portion 60 and a sleeve portion 62 surrounding the core portion 60. The core portion 60 has a serrated or knurled cylindrical outer surface 76 with a reduced diameter portion 66 having an annular channel 68 extending therearound near one end. The core portion 60 is first screwed onto the threaded rod 58 until its reduced diameter portion 66 has completely entered the circular hole 20 in the end wall 17, with the annular channel 68 then being positioned on the appropriate side of the end wall 17 in the slot 14. A lock ring 70 is then snapped into the annular channel 68 to retain the core portion 60 in engagement with the body 12. The core portion 60 is therefore secured in the end wall 17 of the body 12, while being rotatable relative thereto.

Before assembling the sleeve portion 62 with the core portion 60, the length of the powder receiving chamber 56 is extended to a predetermined length by turning the core portion 60 clockwise to position the slide 34 accordingly. Also, the sleeve portion 62 is not assembled with the core portion 60 until the width of the powder receiving chamber 56 has been reduced to a predetermined width by turning the set screw 72 clockwise.

The sleeve portion 62 is then assembled with the core portion 60 by sliding the cylindrical inner surface 74 of the sleeve portion over the serrated and horizontally knurled cylindrical outer surface 76 of the core portion 60. The outer diameter of the core portion 60 and the inner diameter of the sleeve portion 62 are such that a press fit is effected therebetween. The sleeve portion 62 has circumferential scale markings 78. Before the sleeve portion 62 is assembled with the core portion 60, the sleeve portion 62 is manually rotated relative to the core portion 60 until the zero mark of the scale markings 78 is in alignment with the line of reference 28 at the end of the body 12.

The shot receiving slot 16 contains a slider 80 of synthetic plastic material and which extends the full height and width of the slot 16 and forms a shot receiving chamber 82 with the inner end of the slot 16. The slider 80 has a non-rotatable rod 58 extending therefrom through the aperture 22 in the end wall 15 and through an adjusting nut 64 rotatably mounted at the respective end of the body 12, in a similar manner to rod 58 and nut 64 associated with the slider 34. The slider 80 is held in position by a spring pin 134 extending through an aperture 35 in the body 12 into a longitudinally extending groove 136 in a side wall of the slider 80. The adjusting nut 64 associated with the slider 80 is assembled in the same manner as was described in connection with the slider 34. The upper surfaces of the sliders 34, 80 each have an axially placed transverse marking 84 which is alignable with corresponding scale markings 86 on an adjacent portion of the top surface of the body 12 to form a scale arrangement.

The powder and shot receiving chambers 56, 82 are differently shaped in a manner which takes into account the different physical properties of powder and shot. The inner end of the powder receiving chamber 56 is formed by the U-shaped aluminum sleeve 32 which has curved corners 88 between the end and side walls of the powder receiving chamber 56. The insert 50 in the inner end wall of the slider 34 is perpendicular to the longitudinal axis of the body 12 over the major portion of its area, and has curved side edged portions 90 which project towards and engage the side walls of the aluminum sleeve 32. As shown more particularly in FIG. 3, these features produce a powder receiving chamber 56 which in plan view has the shape of a rectangle with curved corners. This results in a more uniform metering of powders. The powder receiving chamber 56 is thus made of aluminum which eliminates the possibility of static electricity retaining some of the powder in this chamber 56 during a reloading cycle, which will be described later. The inner end of the shot receiving chamber 82 also has curved corners 92 between the end and side walls of the shot receiving slot 16. The end face 94 of the slider 80 forming one wall of the chamber 82 has a re-entrant V-shape extending from the top to the bottom. This V-shape reduces the likelihood of shearing of shot pellets during a shot loading operation, which will be explained later.

Adjacent each end of the body 12, a small tapped hole 96 extends inwardly from one side thereof and holds a set screw 98 which can be screwed in to engage the reduced diameter portion 66 of the core portion 60 of the respective adjusting nut 64 so as to secure the nut 64 in a selected setting. The central portion 18 of the body 12 has a threaded bore 100 extending inwardly from one side thereof, and in which a bolt with a projecting head 102 is secured. The purpose of the bolt head 102 will be described later.

In use, the charge bar 10 is mounted in a shotgun shell reloading machine as shown in FIGS. 16 and 17, which illustrate the upper part of the reloading machine. The charge bar 10 is slidably mounted in a bracket 104 so that it can be manually reciprocated in the bracket. The front wall 106 of the bracket 104 has a horizontally elongated slot 108 in which the bolt head 102 is located to limit reciprocating movement of the charge bar 10.

The bracket 104 has a base 110 with a central aperture 112 which communicates with a downwardly extending drop tube 114. The bracket 104 also has a top plate 116 with a pair of longitudinally spaced apertures 118 which each contain a sealing ring 120. Internally threaded annular walls 122 extend upwardly from the top plate 116 and surround the apertures 118. Powder and shot containers 124, 126 respectively have externally threaded necks 128, 130 which are secured into the respective annular walls 122. The top plate 116 and rear bracket wall (not shown) are hingedly attached to the remainder of the reloading machine so that they can be swung clear off the drop tube 114 to permit removal and insertion of the charge bar 10.

The other parts of the reloading machine are conventional, and hence it is not necessary to describe the parts of the machine which are concerned with re-priming or re-crimping a used shotgun shell. As previously mentioned, the present invention is concerned with the charge bar by means of which variable predetermined quantities of powder and shot are supplied to a shell.

At a suitable stage in the reloading operation, a used shell (not shown) is positioned at the lower end of the drop tube 114. With the charge bar 10 in its extreme right hand position (as shown in FIGS. 16 and 17, with the bolt head 102 consequently at the right hand end of the slot 108), powder from the container 124 fills the powder chamber 56 in the charge bar 10. The charge bar 10 is then pushed to its extreme left and positioned with the bolt head 102 at the left hand end of the slot 108. The powder chamber 56 is then aligned with the drop tube 114, so that the measured quantity of powder in the chamber 56 drops down the tube 114 into the shell. When the charge bar 10 is in its left hand position, the shot chamber 82 is aligned with the shot container 126 so that shot from the container 126 fills the shot chamber 82. The charge bar 10 is then moved back to its right hand position, as shown in FIGS. 16 and 17, in which the shot chamber 82 is aligned with the drop tube 114, so that the measured quantity of shot in the chamber 82 falls down the drop tube 114 into the shell. At the same time, the powder chamber 56 is refilled ready for the next filling operation.

The amounts of powder and shot supplied to a shell depend of course on the volume of the powder and shot chambers 56, 82. The volumes of these chambers 56, 82 can be accurately varied by rotating the adjusting nuts 64 (when the set screws 98 are released from the reduced diameter portion 66 of the core portion 60 of the nut 64). Rotation of a nut 64, which is longitudinally fixed in the end of the charge bar body 12, causes longitudinal movement of the slider 34 or 80, as the case may be, thereby adjusting the size of the chambers 56 or 82.

When reloading a shell with a machine utilizing the charge bar, the user first determines the amount of shot and the kind and amount of powder from a powder and shot chart (not shown). These readings are then applied to the scales 86 on the body 12, and to the scales 78 on the nuts 64, by aligning each scale 86 with the reference markings 84 in accordance with the respective reading, and by aligning each scale 78 in accordance with the respective reading with the reference marking 28 at the respective end of the bar body 12. The charge bar 10 is then set to dispense the desired quantities of shot and powder without any preliminary trials having to be made.

As shown in FIG. 14, the scales 78 are divided into eight numbered sections, marked 0 to 7. These sections are each divided into four sub-sections, making a total of thirty-two sub-sections around the circumference. The scales 86 on the body 12 are marked 0 to 1, and divided into sixteen segments. For convenience, these segments will be referred to by number, 0, 1, 2, 3, etc. The first eleven segments have been numbered in FIG. 18. Every reading from the chart consists of two numbers. For example, for a certain amount of one powder, the reading may be 5+44. The first number 5, indicates the position of the 0-marking 84 on the slider 34 in relation to the scale 86 on the body 12. In this case, the 0-marking 84 is to be aligned with the 5th line from the 0-line of the scale 86 on the body 12. The second number, 44, indicates the number of the sub-section of the scale 78 which is to be turned to the reference line 28. In this case, forty-four sub-sections is one whole turn of the nut 64 (thirty-two sub-sections) plus twelve more sub-sections. The readings for the shot charge indicate settings for the slider 80 in the same way.

For accuracy, it is preferable that all settings of a nut 64 are arrived at by turning the nut 64 clockwise. If a nut 64 has been accidentally turned past the desired setting, the nut 64 should be turned back one whole turn, and the setting be approached again in a clockwise manner.

For a reading of 5+44, the nut 64 is first turned until the 0-mark 84 of the slider 34 is at approximately one marking less, namely the fourth marking, from the 0-line on the scale 86. The nut 64 is then turned clockwise until the 0-mark 84 of the slider 34 is in line with the fifth marking on the scale 86, and the 0-mark on the scale 78 of the nut 64 is aligned with the line of reference 28. Subsequently, the nut 64 is turned clockwise the additional number of markings (on the scale 78) indicated by the second number 44. In this case, the final setting of the nut 64 will be one whole turn of the nut 64 and twelve sub-sections more than the 0-mark on the scale 78. When the correct setting has been achieved, the set screw 98 at the end of the body 12 is tightened against the reduced diameter portion 66 of the core portion 60 of the nut 64, in order to maintain the same setting during the operation of the charge bar 10.

The setting for the shot receiving chamber 82 is effected in the same way as for the powder receiving chamber 56.

The described charge bar can therefore be used for reloading shells of various sizes with accurately predetermined amounts of powder and shot.

Besides the functional advantages explained above, the described charge bar can be accurately manufactured in a relatively inexpensive manner since, as previously mentioned, the body 12 and the sliders 34 and 80 are made of synthetic plastic material. The core portion 60 and the sleeve portion 62 of the nut 64 are machined products, the core portions 60 being made of steel and the sleeve portions 62 being made of extruded aluminum.

Various modifications to the described embodiment, within the scope of the invention, will be apparent to a person skilled in the art, the scope of the invention being defined in the appended claims.

What I claim as new and desire to protect by Letters Patent of the United States is:

1. An adjustable charge bar for a shotgun shell reloading machine, said charge bar including an elongated body having longitudinally spaced powder and shot receiving slots open at the top and bottom of the body, a longitudinally movable slider in each slot forming variable volume powder and shot receiving chambers respectively with an inner end of the respective slot, an adjusting nut rotatably mounted at each end of the body and threadingly engaged by a rod extending from a respective slider such that rotation of the nut adjusts the longitudinal position of the respective slider in the body and thereby varies the volume of the respective chamber, each nut having a core portion into which the respective rod extends in threading engagement and a sleeve portion carrying scale markings alignable with a reference marking on the body, the sleeve portion being capable of assembly into fixed relationship with the core portion, after the respective slider has been moved to a predetermined position by rotation of the core portion, to position the scale markings on the sleeve part in a desired relationship with the reference marking on the body.

2. A charge bar according to claim 1 wherein the core portion of each nut has a generally cylindrical uneven outer surface, and the sleeve portion is dimensioned such that the sleeve portion can be force-fitted over the uneven outer surface, at any desired rotational position of the sleeve portion relative to the core portion, to achieve said assembly into fixed relationship.

3. An adjustable charge bar according to claim 1 wherein the body and sliders are made of synthetic plastic material, the powder receiving slot is lined with a metallic insert and the slider in the powder receiving slot has a metallic insert on its end forming the powder receiving chamber, such that the powder receiving chamber is bounded by metal walls.

4. A charge bar according to claim 1 wherein the body carries scale markings adjacent each slider, and each slider carries a reference marking alignable with the respective body scale markings.

* * * * *